US005084974A

United States Patent [19]

Sukow et al.

[11] Patent Number: 5,084,974

[45] Date of Patent: Feb. 4, 1992

[54] CLIPPER WITH LEVER ACTUATED ADJUSTABLE COMB

[75] Inventors: Daniel L. Sukow, Grafton; Daniel C. Quella; Matthew L. Andis, both of Racine, all of Wis.

[73] Assignee: Andis Company, Racine, Wis.

[21] Appl. No.: 643,340

[22] Filed: Jan. 22, 1991

[51] Int. Cl.[5] ..... B26B 19/20

[52] U.S. Cl. ..... 30/201; 30/233

[58] Field of Search ..... 30/200–202, 30/233, 233.5, 43.1, 293

[56] References Cited

U.S. PATENT DOCUMENTS 4,776,095 10/1988 Tsujimoto et al. ..... 30/201

4,949,460 8/1990 Sterk ..... 30/201

*Primary Examiner*—Douglas D. Watts

*Attorney, Agent, or Firm*—Michael, Best & Friedrich

[57] ABSTRACT

A hair trimmer including a body having opposite ends and an axis extending between the opposite ends, a blade set mounted on the body at one of the opposite ends, a comb disposed on the one end of the body for axial movement relative to the blade set, a lever supported by the comb for rotatably engaging the body, and a mechanism for axially displacing the comb in response to rotation of the lever.

19 Claims, 3 Drawing Sheets

CLIPPER WITH LEVER ACTUATED ADJUSTABLE COMB

BACKGROUND OF THE INVENTION

1. Technical Field

The invention relates generally to hair trimmers and to combs which are attachable to such hair trimmers to assist the user in cutting hair to a particular length.

2. Related Prior Art

It is generally known to provide different sized combs for use with a hair trimmer to facilitate the cutting of hair to different lengths. The user of such a trimmer changes the associated comb to facilitate the cutting of hair to a different length.

Attention is directed to U.S. Pat. No. 4,845,852, which issued to Andis on July 11, 1989, and which illustrates a hair trimmer with a comb and means for adjusting the position of the comb relative to the trimmer.

SUMMARY OF THE INVENTION

The invention provides an electric hair trimmer adapted to support thereon a comb for slidable movement relative thereto, and means including a lever for adjusting the position of the comb on the trimmer. More specifically, the trimmer is adapted to selectively and slidably support thereon a comb so that the comb is movable with respect to a blade set on the trimmer. In order to facilitate the cutting of hair with the trimmer to various particular lengths, the comb supports adjustment means which is engageable with the trimmer and which can be used to adjust the position of the comb relative to the blade set.

In one embodiment, the trimmer includes a body which has opposite ends and an axis which extends between the opposite ends, a blade set which is mounted on the body at one of the opposite ends, a comb disposed on one end of the body for axial movement relative to the blade set, and means including a lever for axially displacing the comb in response to rotation of the lever.

In another embodiment, the trimmer includes a body having opposite ends and an axis extending between the ends, a pin extending outwardly from the body, and a comb engageable with the body and moveable relative to the body and including adjustment means for releaseably engaging the pin and for selectively adjustably displacing the comb along the axis.

In another embodiment, the hair trimmer includes a body having opposite ends and an axis extending between the ends, a comb supported on the body for axial movement along the body, and user actuable pinion means supported by the comb and engageable with the body for axially displacing the comb relative to the body.

Various other features and advantages of the invention will become apparent to those skilled in the art upon review of the following detailed description, claims, and drawings.

Figure 1:
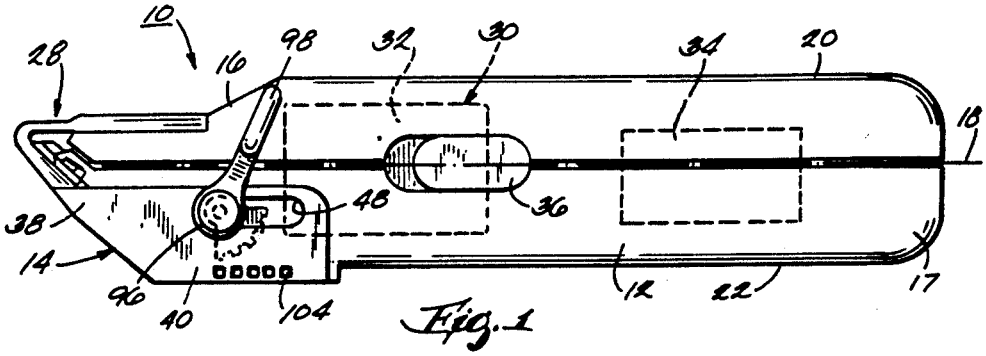
FIG. 1 is a side elevational view of a hair trimmer embodying various features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Figure 3:
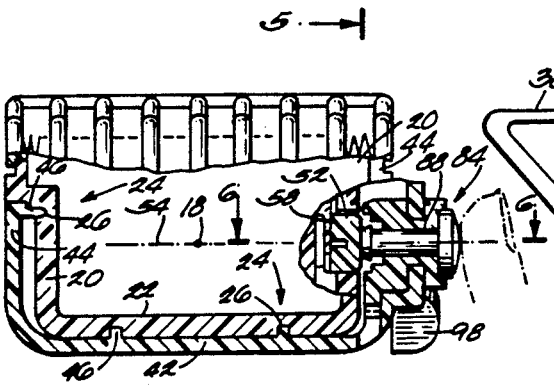
FIG. 3 is a cross-sectional view taken along line 3—3 in FIG. 2.

Illustrated in the drawings is an electric hair trimmer 10 having a body 12 which is formed to be easily handheld and which is adapted to slidably support thereon a comb 14. The trimmer body 12 has opposite ends 16, 17, a longitudinal axis 18 extending between the opposite ends 16, and 17, (FIG. 3) a pair of side walls 20, and a bottom wall 22. The trimmer body 12 also includes means 24 for slidably and selectively supporting thereon a comb. Preferably, the means 24 for supporting the comb 14 includes a plurality of axially extending grooves 26 which are defined by the side walls 20 and the bottom wall 22 and which extend from one end 16 of the trimmer body 12.

The trimmer 10 includes a blade set 28 which is adapted to cut hair and which is supported by the one end 16 of the body 12. The trimmer 10 also includes means 30 for actuating the blade set including, in the illustrated embodiment, (as indicated schematically by the phantom lines in FIG. 1) an electric motor 32 housed by the body 12, and a suitable source 34 of current for the electric motor 32 which can be in the form of a battery and which can also be housed by the trimmer body 12. The trimmer 10 also includes a user operable thumb switch 36 which is disposed on the outer surface of the body 12 for turning the electric motor 32 "on" and "off".

The comb 14 is adapted to be selectively, slidably supported on the end 16 of the trimmer body 12 by the means 24 in a position overlying the blade set 28. In the illustrated embodiment, the comb 14 comprises a comb portion 38 which is located adjacent the blade set 28 and which can be of any suitable construction, and a sleeve portion 40 which extends from the comb portion 38 and which has a cross-sectional configuration which affords movement of the comb 14 along and lengthwise of the trimmer body 12, or in the direction of the axis 18, to adjustably locate the comb portion 38 relative to the blade set 28. To assure sliding alignment of the sleeve portion 40 and the trimmer body 12, the sleeve portion 40 includes a bottom wall 42, a pair of side walls 44 which extend upwardly from the bottom wall 42, and a plurality of axially extending guide rails 46 which are disposed on the inner surfaces of the bottom and side walls 44, 42 and which, when the comb 14 is positioned on the trimmer 10, register with and slidably engage the grooves 26 in the trimmer body 12. The sleeve portion 40 also includes, for reasons discussed below, an elongated slot 48 which extends through one of the side walls 44 of the sleeve 40 and which extends generally parallel to the axis 18 when the comb 14 is positioned on the trimmer 10.

The trimmer 10 also includes means 50 supported by the body 12 and the comb 14 for selectively securing the comb 14 on the body. While various other constructions could be successfully employed, in the illustrated embodiment, the means 50 for securing the comb 14 on the body 12 includes (FIGS. 3, 6, 10) a location pin 52 disposed on one of the sides of the trimmer body 12. The pin 52 extends from the side 20 of the trimmer body along a second axis 54 which is generally perpendicular to the longitudinal axis 18 of the body 12 and faces the sidewall 44 of the sleeve portion 40 which includes the slot 48. The pin 52 extends from the body 12 at a location which affords registery of the pin 52 and the slot 48 when the comb 14 is positioned on the trimmer body 12.

Figure 6:
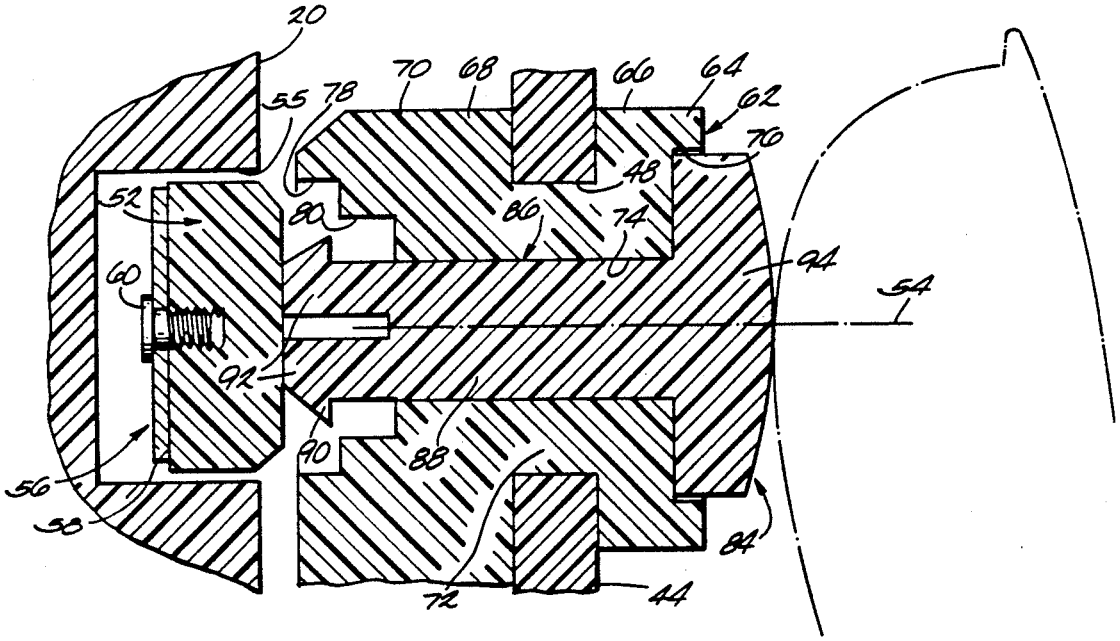
FIG. 6 is an enlarged, cross-sectional view taken along line 6—6 in FIG. 3.

For reasons explained below, the trimmer body 12 houses the pin 52 so that the pin 52 is movable inwardly of the body 12 along the second axis 54. To this end, and as best shown in FIG. 6, the pin 52 is housed by a cavity 55 in the body 12. The trimmer 10 also includes means 56 for biasing the pin 52 outwardly of the body 12 so that a length of the pin 52 extends from the side 20 of the body 12. In the embodiment illustrated by FIG. 6, the means 56 for biasing the pin 52 outwardly includes a leaf spring 58 which is engaged with the body 12 by means of a pair of retaining ribs 59, and which are fixed to the inner end of the pin 52 by means of a fastener 60.

Figure 10:
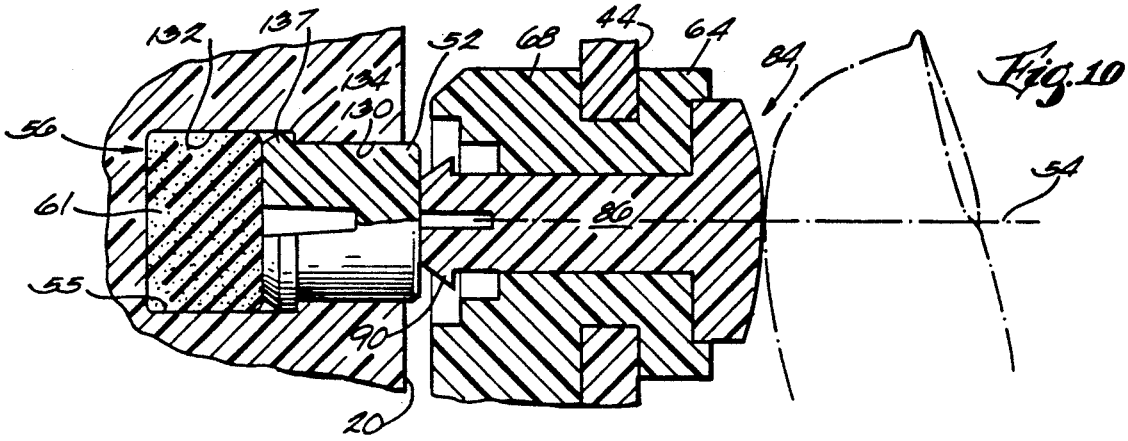
FIG. 10 is a view similar to FIG. 6 illustrating an alternative embodiment of the hair trimmer.

In an alternative embodiment of the hair trimmer 10, illustrated in FIG. 10, and the means 56 for biasing the pin 52 outwardly includes an elastomer spring 61 which is housed in the body 12 by cavity 55 and is retained therein by the pin 52. In the embodiment illustrated in FIG. 10, the cavity 55 has a first portion 130 which opens into the side wall 20 of the body 12 and a second portion 132 which is located inward of the first portion 130 and which is defined by an inwardly extending step 134. The pin 52 has a split-head 136 comprising two halves 137 which can be moved together so that during assembly, the split head 136 can move into and through the first portion 130 of the cavity 55 and past the step 134. Once assembled, the split-head 136 engages the spring 61 and is biased outwardly of the cavity 55. The split-head 136 prevents the pin 52 from being biased out of the cavity 55 by the spring 61 due to engagement of the inwardly extending step 134 by the halves 137 of the split-head 136. Normally, a length of the pin 52 extends from the side 20 of the trimmer body 12, but the pin 52 can be moved along the second axis 54 and into the cavity 55 so that the split-head 136 engages and compresses the spring 61 and so that, as shown in FIGS. 6 and 10, the outer end of the pin 52 is substantially flush with the side wall 20.

The means 50 for selectively securing the comb 14 on the body 12 also includes (FIGS. 3 and 6) a generally cylindrical follower member 62 which extends through the slot 48 in the sidewall 44 of the comb 14. The follower member 62 has a first or outer end 64 which extends past the outer surface of the side wall 44 of the comb 14 and which supports a first generally cylindrical portion 66 having a diameter greater than the width of the slot 48, a second or inner end 68 which extends past the inner surface of the sidewall 44 of the comb 14 and which supports a second generally cylindrical portion 70 having a diameter greater than the slot 48, and a generally cylindrical central portion 72 which extends between the first and second ends 64, 68. Preferably, the central portion 72 has an outer diameter which is sized to slidably engage the slot 48 and to move relatively freely along the length of the slot 48. Because the location pin 52 and the slot 48 can be registered when the comb 14 is positioned on the trimmer body 12, the follower member 62 can be aligned with the pin 52 along the second axis 54.

The follower member 62 has therethrough a bore 74 which extends between the first and second ends 64, 68. The bore 74 forms, at the outer end 64, a counterbore 76, and at the inner end 68, a generally circular detent 78 and a second counterbore 80 which has a diameter which is smaller than the diameter of the detent 78. Preferably, the detent 78 is sufficiently large so that the detent 78 can surround the circumference of the location pin 52 when the location pin 52 and the follower member 62 are aligned along the second axis 54. Preferably, the outer circumference of the inner portion 66 of the follower 62 and the outer end of the location pin 52 are chamferred so that the follower 62 can engage the pin 52 (FIG. 6) to move the pin 52 inwardly of the body 12 and can be moved into alignment with the pin.

In order to selectively secure the comb 14 on the trimmer body 12, the user can align the guide rails 46 on the comb 14 with the grooves 26 in the end 16 of the trimmer body 12 and slide the comb 14 rearwardly. When the inner portion 66 of the follower member 62 engages the location pin 52, further rearward movement of the comb 14 biases the location pin 52 inwardly of the cavity 55. When the comb 14 is moved further rearwardly to a position wherein the detent 78 in the inner portion 66 of the follower 62 registers with the location pin 52, the leaf spring 58 biases the pin 52 outwardly and into engagement with the detent 78. When the pin 52 moves outwardly and engages the detent 78, it is preferable that the location pin 52 makes an audible "click" to indicate to the user that the comb 14 is properly secured on the body 12. When the location pin 52 and the follower member 62 are engaged, the follower 62 is secured to the body 12 so that the follower 62 can not be moved relative to the body 12 along the longitudinal axis 18, but can be rotated relative to the body 12 about the second axis 54.

The means 50 for selectively securing the comb 14 on the body 12 also includes (FIG. 6) a release button 84 which is housed by the follower member 62. The release button 84 includes an ejector pin 86 which has a shank 88 extending through the bore 74, and a head 90 located at one end of the shank 88 which allows the shank 88 to be inserted into the bore 74 at the outer end 68 of the follower 62 but which, after assembly, retains the shank 88 inside the bore 74. In the preferred embodiment, the head 90 is generally frusto-conical and is split into two generally cylindrical spaced-apart halves 92. When the ejector pin 86 is inserted into the bore 74 at the outer end 68 of the follower 62, the halves 92 of the head 90 are compressed together to allow the head 90 to be moved toward the inner end 64 of the follower 62. When the head 90 extends into the second counterbore 80, however, the halves 92 of the head 90 move apart and into engagement with the second counterbore 80. As mentioned above, the circumference of the head 90 is preferably sufficiently large to prevent the ejector pin 86 from being disassembled from the follower 62.

The release button 84 also includes a cap 94 which is fixed to the end of the shank 88 opposite the head 90 and which is sized to be housed by the first counterbore 76 in the outer portion 70 of the follower 62. The length of the shank 88 between the head 90 and the cap 94 is sufficiently long to afford movement of the release button 84 along the bore 74 so that the head 90 of the ejector pin 86 can be moved from the inner counterbore 80 and into the detent 78.

In order to remove the comb 14 from the trimmer body 12, the user can disengage the location pin 52 from the follower 62 by use of the release button 84. By moving the release button 84 inwardly of the follower 62 along the second axis 54, the user can move the head 90 of the ejector pin 86 into engagement with the location pin 52 to bias the location pin 52 inwardly of the cavity 55 along the second axis 54 and out of engagement with the follower member 62. The comb 14 can then be slidably removed from the trimmer body 12.

Figure 2:
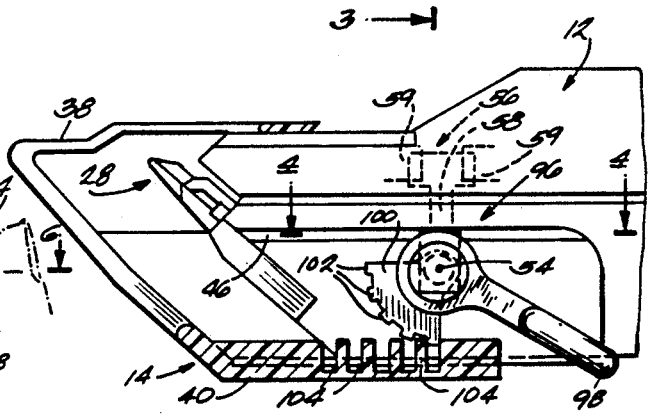
FIG. 2 is an enlarged view, partially broken away for illustration, and with some details omitted for clarity, of a portion of the hair trimmer illustrated in FIG. 1.

The trimmer 10 also includes (FIG. 2) adjustment means 96 including a lever 98 for displacing the comb 14 relative to the body 12 along the longitudinal axis 18. While various other constructions could be employed, in the illustrated embodiment, the adjustment means 96 includes the above-mentioned lever 98 which is fixed to the outer end 68 of the follower member 62 so that the lever 98 extends outside the sidewall 44 of the comb 14 and so that rotation of the lever 98 rotates the follower portion 62.

Figure 5:
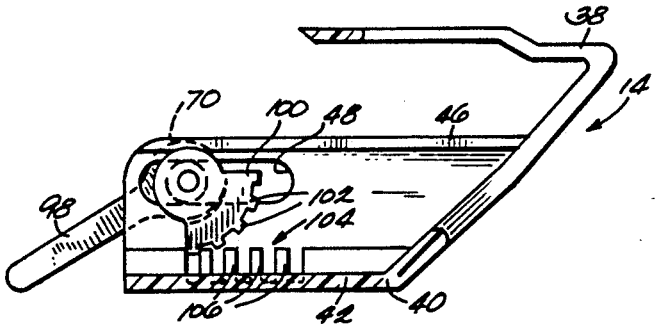
FIG. 5 is a cross-sectional view taken along line 5—5 in FIG. 3.
Figure 4:
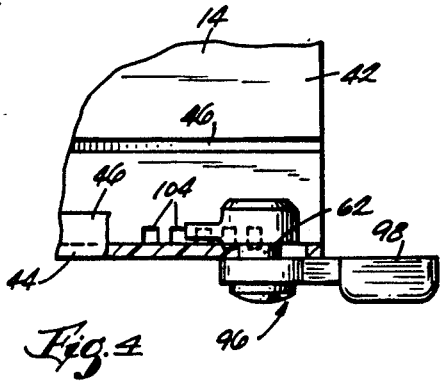
FIG. 4 is a cross-sectional view taken along line 4—4 in FIG. 2.

The adjustment means 96 also includes (FIGS. 3-5) a pinioned cam 100 which extends radially with respect to the second axis 54 from the inner end 68 of the follower member 62 on the inside of the sleeve portion 40. When the comb 14 is positioned on the trimmer body 12, the pinioned cam 100 is located between the side 20 of the trimmer body 12 and the sidewall 44 of the sleeve portion 40. While various other constructions could be employed, in the illustrated embodiment, the pinioned cam 100 comprises a generally circular segment which defines a generally circular arc having an arc length of approximately 90°. The pinioned cam 100 includes a plurality of teeth 102 which are disposed on the circumference of the circular segment, which extend radially from the circumference of the cam 100, and which are spaced-apart along the arc of the cam 100. The adjustment means 96 also includes a rack 104 which is supported by the bottom wall 42 of the sleeve portion 40 of the comb 14, which extends generally parallel to the longitudinal axis 18, and which extends substantially along the length of the slot 48. The rack 104 includes a plurality of aligned teeth 106 which extend upwardly from the bottom wall 42 of the sleeve 40 and which are spaced-apart so as to mesh the teeth 102 of the pinioned cam 100 as the cam rotates 100. As described below, the rack 104 and pinioned cam 100 cooperate to move the follower member 62 along the length of the slot 48 in the comb 14 when the lever 98, and thus the follower 62 and the pinioned cam 100 are rotated.

When the comb 14 is selectively secured to the trimmer body 12 in the manner described above, the user can adjust the position of the comb 14 relative to the blade set 28 by rotating the lever 98. Because, when the follower 62 is engaged with the location pin 52, the follower 62 is axially fixed relative to the trimmer body and longitudinal axis 18, rotation of the lever 98 and the follower 62 about the second axis 54 causes the teeth 102 on the cam 100 to mesh with the teeth 106 in the rack 104 and to move the rack 104, and therefore the comb 14, axially along the grooves 26 relative to the follower member 62, and therefore axially relative to the trimmer body 12 and to the blade set 28. Rotation of the lever 98 thus displaces the comb 14 axially with respect to the blade set 28.

Figure 7:
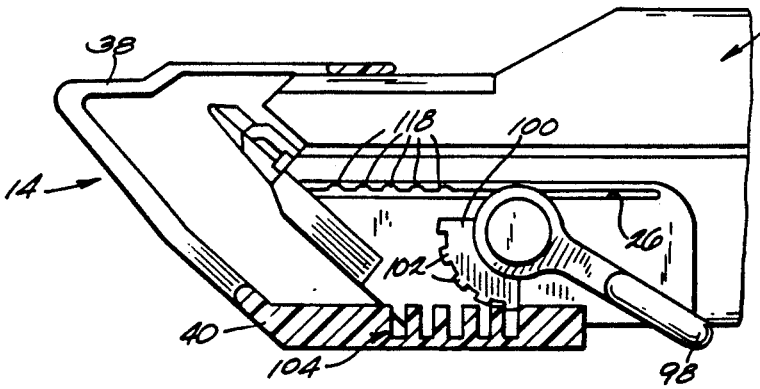
FIG. 7 is a view similar to FIG. 2, with some details omitted for clarity, illustrating an alternative embodiment of the hair trimmer.
Figure 8:
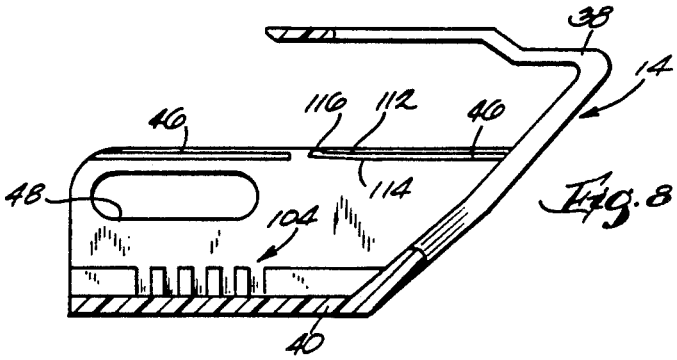
FIG. 8 is a view similar to FIG. 5 illustrating the embodiment shown in FIG. 7.
Figure 9:
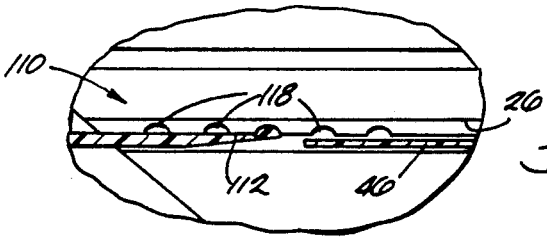
FIG. 9 is an enlarged, cross-sectional view of a portion of the comb illustrated in FIG. 8 engaged with the trimmer body illustrated in FIG. 7.

In the embodiment of the hair trimmer 10 illustrated in FIGS. 7-9, the adjustment means 96 also includes means 110 for selectively retaining the comb 14 in one of a plurality of positions along the longitudinal axis 18. While various other constructions could be employed, in the illustrated embodiment, the retaining means 110 includes a spring arm 112 which is supported by and extends slightly upwardly from one of the guide rails 46. The spring arm 112 has (FIG. 8) a first end 114 which is fixed to the guide rail 46 and which is preferably integrally formed therewith, and a second end 116 which, for reasons discussed below is preferably generally rounded. The spring arm 112 is resiliently movable between an undeflected position and a depressed position wherein the spring arm 112 lies along the guide rail 46. The retaining means 110 also includes (FIG. 7) a plurality of detents or pockets 118 which are defined by the side 20 of the body adjacent the grooves 26 therein and which extend generally upwardly from the grooves 26.

The spring arm 112 and the detents 118 cooperate to selectively retain the comb 14 in one of a plurality of positions on the body 12. When the comb 14 is selectively positioned on the body 12, the spring arm 112 is normally held in the depressed position by the groove 26. As the user adjusts the position of the comb 14 in the above-described manner, the comb can move to a position (FIG. 9) wherein the rounded end 116 of the spring arm 112 registers with one of the detents 118. In that position, the spring arm 112 moves upwardly from the depressed position to the undeflected position and the rounded end 116 of the spring arm 112 engages the detent 118 to retain the comb 14 in that position. Continued adjustment of the comb along the body 12 moves the spring arm 112 out of engagement with the detent 118 and downwardly into the depressed position, thereby affording sliding movement of the comb 14 along the body 12.

Various other features of the invention are set forth in the following claims.

We claim:

1. A hair trimmer comprising a body having opposite ends and an axis extending between said opposite ends, a blade set mounted on said body at one of said opposite ends, a comb disposed on said one end of said body for axial movement relative to said blade set, and means including a lever for axially displacing said comb in response to rotation of said lever.

2. A hair trimmer as set forth in claim 1 wherein said comb supports said lever, and wherein said lever is releaseably and rotatably engageable with said body.

3. A hair trimmer as set forth in claim 2 and further including a pin extending from either the body or the comb and releaseably engageable with the other of said body or said comb.

4. A hair trimmer as set forth in claim 3 wherein said lever is rotatable about an axis, and wherein said pin can be moved along said axis of rotation of said lever.

5. A hair trimmer as set forth in claim 4 and further including a pinion supported by said lever and a rack supported by said comb and engaged with said pinion, said pinion and said rack cooperating for axial displacement of said comb.

6. A hair trimmer comprising a body having opposite ends and an axis extending between said ends, a pin extending outwardly from said body, and a comb engageable with said body and movable relative to said body along said axis and including means on said comb for engaging said pin to selectively permit and prevent removal of said comb from said body, said engaging means being movable relative to said comb along said axis, and means for selectively adjustably displacing said comb along said axis.

7. A hair trimmer comprising a body having opposite ends and a first axis extending between said ends, a pin extending outwardly from said body along a second axis which extends generally perpendicularly to said first axis, and a comb movable relative to said body along said first axis and including adjustment means for releaseably engaging said pin and for selectively adjustably displacing said comb along said first axis.

8. A hair trimmer as set forth in claim 7 wherein said pin is moveable along said second axis relative to said body.

9. A hair trimmer comprising a body having opposite ends, an axis extending between said ends, and a pair of side walls respectively defining a pair of axially extending grooves, a pin extending outwardly from said body, and a comb engageable with said grooves and movable relative to said body along said axis and including adjustment means for releaseably engaging said pin and for selectively adjustably displacing said comb along said axis.

10. A hair trimmer as set forth in claim 9 wherein said comb includes a lever which is rotatable with respect to said comb.

11. A hair trimmer as set forth in claim 10 wherein said lever is rotatably engageable with said pin.

12. A hair trimmer as set forth in claim 11 wherein said lever is releaseably engageable with said pin.

13. A hair trimmer as set forth in claim 12 and further including pinion means fixed to said lever and rack means fixed to said comb and extending generally parallel to said axis of said body, and wherein said pinion and rack are engaged and cooperate for axial displacement of said comb relative to said body in response to rotation of said lever.

14. A hair trimmer comprising a body having opposite ends and an axis extending between said ends, a comb supported on said body for axial movement along said body, user actuable pinion means axially and rotationally movable relative to said comb for axially displacing said comb relative to said body, means on said comb supporting said pinion means and being axially and rotationally movable relative to said comb, and means on said housing for selective engagement with said supporting means and providing an axis of rotation for said supporting means and said pinion means.

15. A hair trimmer as set forth in claim 14 wherein said pinion is rotatable about a second axis which extends generally perpendicularly to said axis of said body.

16. A hair trimmer as set forth in claim 15 and further including a pin extending between said pinion means and said body and extending generally parallel to said second axis.

17. A hair trimmer as set forth in claim 16 wherein said pinion is releaseably engageable with said pin.

18. A hair trimmer as set forth in claim 17 wherein said comb includes a rack extending generally parallel to said body axis and wherein said rack is engaged with said pinion.

19. A hair trimmer as set forth in claim 16 wherein said pin is moveable relative to said body along said second axis.

* * * * *